US005492483A

United States Patent [19]

Cheng et al.

[11] Patent Number: 5,492,483

[45] Date of Patent: Feb. 20, 1996

[54] STRUCTURE OF LAMP SOCKET

[76] Inventors: You-Jen Cheng; Tzu-Ling Cheng, both of 2nd Fl., 18-9, Tienmu W. Road, Taipei City, Taiwan

[21] Appl. No.: 391,105

[22] Filed: Feb. 21, 1995

Related U.S. Application Data

[63] Continuation-in-part of Ser. No. 270,600, Jul. 5, 1994.

[51] Int. Cl.[6] ..... H01R 4/50

[52] U.S. Cl. ..... 439/339; 439/419

[58] Field of Search ..... 439/306, 339, 439/340, 356, 366, 414, 419, 665; 313/318

[56] References Cited

U.S. PATENT DOCUMENTS

| | | | |
|---|---|---|---|
| 1,710,373 | 4/1929 | Moore | 439/306 |
| 1,738,341 | 12/1929 | Wille | 439/665 |
| 2,308,016 | 1/1943 | Mihalyi | 439/356 X |
| 2,570,751 | 10/1995 | Benander | 439/419 |
| 5,421,742 | 6/1995 | Huang | 439/419 |

*Primary Examiner*—Khiem Nguyen
*Attorney, Agent, or Firm*—Ladas & Parry

[57] ABSTRACT

A lamp socket of the type having a socket body to hold a lamp bulb. A socket cap is fastened to the socket body to hold an electric wire in place, and positive and negative contact plates are mounted in the socket body to connect the electric wire to the lamp bulb electrically. The negative contact plate is mounted in one L-shaped angle slot on the socket body, having a plurality of raised portions bearing against the inside wall of the socket body. A horizontal stop rod stops or rests against the socket body and a toothed projection meshes with a threaded ring contact of the lamp bulb. A locating plate is mounted in an L-shaped angle slot in the socket body remote from the negative contact metal plate, having a plurality of raised portions bearing against the inside wall of the socket body. A horizontal stop rod engages the socket body and a toothed projection meshes with the threaded ring contact of the lamp bulb.

2 Claims, 3 Drawing Sheets

STRUCTURE OF LAMP SOCKET

CROSS-REFERENCE TO RELATED APPLICATION

The present invention is a continuation-in-part of application Ser. No. 08/270,600, filed on Jul. 5, 1994.

In the lamp socket disclosed in U.S. patent application Ser. No. 08/270,600, filed Jul. 5, 1994, pending, there are two toothed locating plates mounted within two vertical mounting holes on the socket body to mesh with the threaded base of the bulb so that the bulb is prohibited from being pulled out of the socket body in the axial direction. This arrangement is functional, however it is complicated, and therefore its manufacturing cost is relatively high. Furthermore, because the toothed locating plates and the negative pole contact metal plate are made having a respective flat outer surface disposed in contact with the inside wall of the socket body directly, frequently mounting and dismounting the bulb will cause elastic fatigue to the toothed locating plates and the negative pole contact metal plate. If the toothed locating plates and the negative pole contact metal plate suffer elastic fatigue, the bulb not be held snugly in the socket, but rather will tend to oscillate after its installation.

SUMMARY OF THE INVENTION

The present invention eliminates the aforesaid drawbacks. According to the preferred embodiment of the present invention, first and second contact plates are mounted in the body of socket. The second contact plate is mounted in an L-shaped slot on the socket body, has a plurality of raised portions which bears against an inside wall of the socket body. A horizontal stop rod on the second contact stops or rests against the socket body, and a toothed projection meshes with a threaded ring contact of the lamp bulb. A locating plate is mounted in the L-shaped slot in the socket body remote from the second contact plate. It also has a plurality of raised portions which bear against the inside wall of the socket body, a horizontal stop rod stopped or resting against the socket body, and a toothed projection which meshes with the threaded ring contact of the lamp bulb. Therefore, the lamp bulb cannot be directly pulled out of the socket body axially, but rather must be unscrewed through rotary motion. Since the second contact plate and the locating plate have raised portions respectively bearing against the inside wall of the socket body, the aforesaid elastic fatigue problem is eliminated.

DETAILED DESCRIPTION OF THE PREFERRED EMBODIMENT

Figure 1:
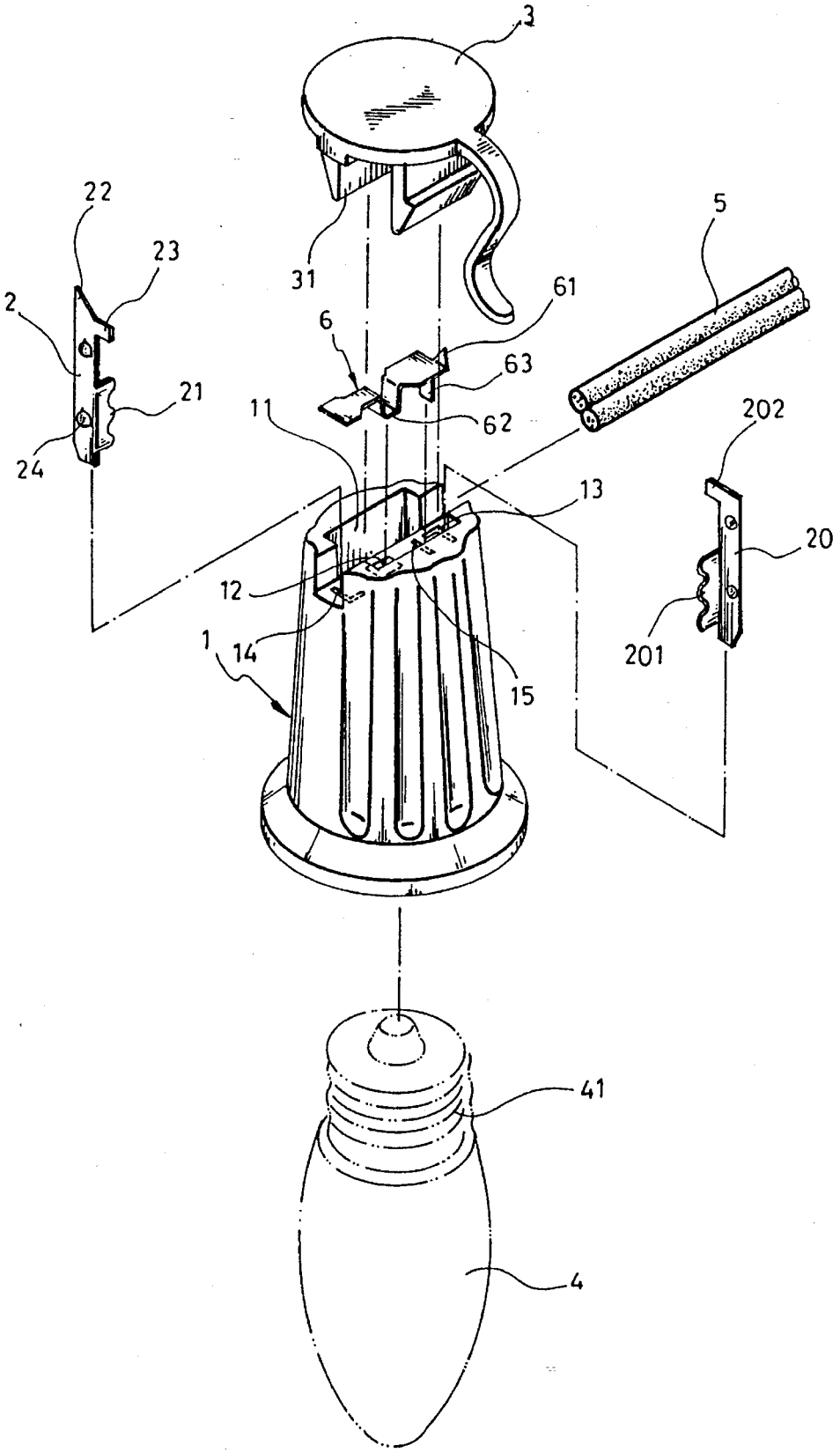
FIG. 1 is an exploded view of a lamp socket according to the present invention.

Referring to FIG. 1, a lamp socket in accordance with the present invention comprises a socket body 1, a negative pole contact metal plate 2, a socket cap 3, and a positive pole contact metal plate 6. The socket body 1 has a wire groove 11 in the top end thereof for receiving an electric wire 5, a center through hole 12 intersecting wire groove 11, and a locating hole 15 adjacent to center through hole 12. The positive pole contact metal plate 6 is of a curved shape and has a downward contact or projection 62 in the middle thereof for insertion into center through hole 12, an upward triangular tip 61 at one end for piercing the insulator of the electric wire 5 to make electric contact with a conductor in the wire, and a downward locating strip 63 adjacent to the triangular tip 61 for insertion into locating hole 15. The socket cap 3 is fastened to the socket body 1 to hold the electric wire 5 in the wire groove 11, by two bottom hooks 31 which hook into respective retaining holes (not shown) on the socket body 1.

Figure 2:
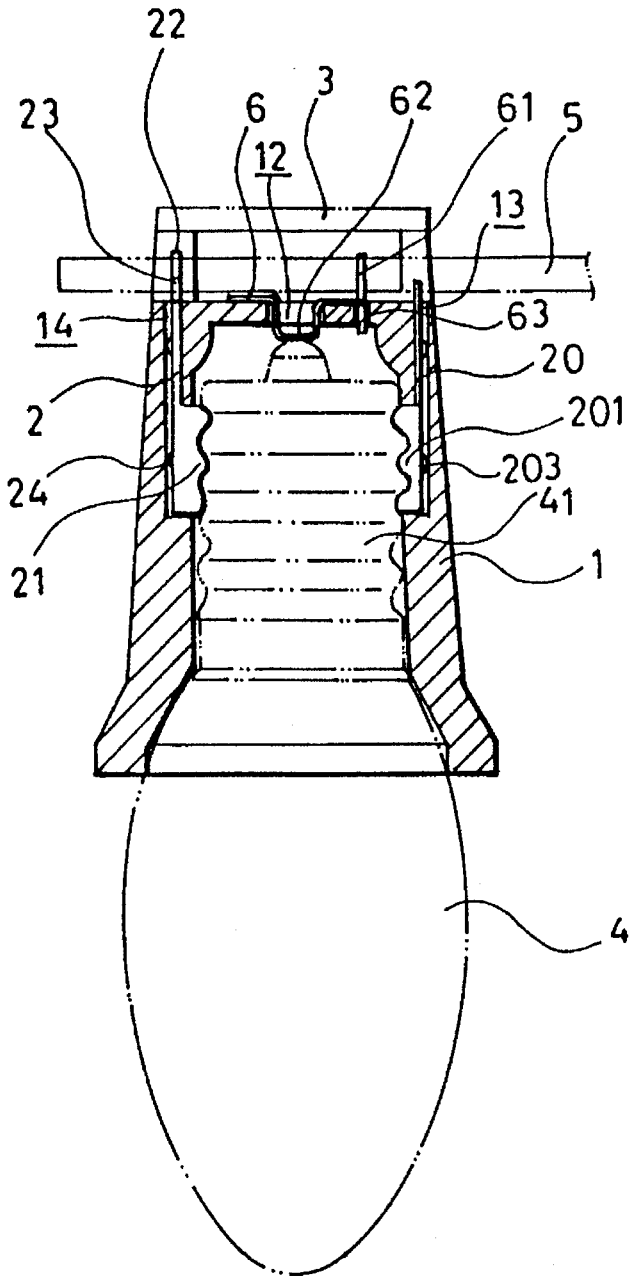
FIG. 2 is a longitudinal view in section of the lamp socket shown in FIG. 1.
Figure 3:
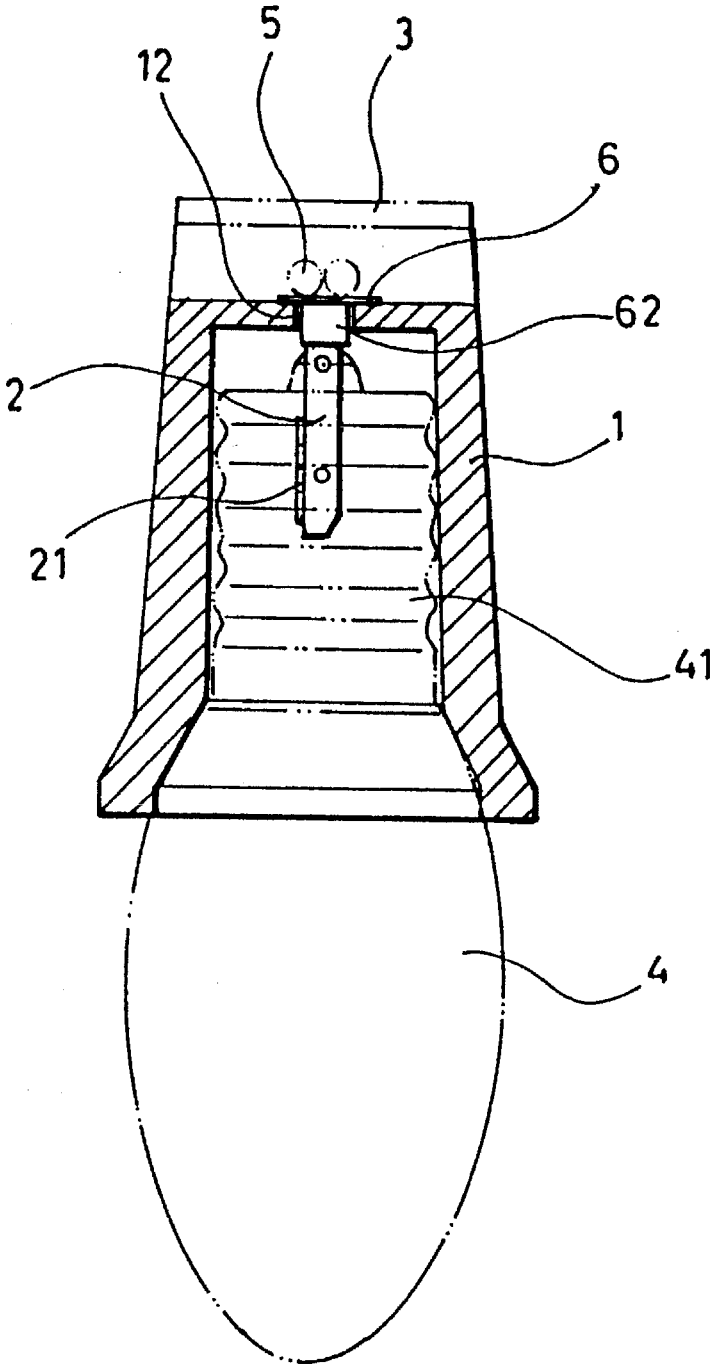
FIG. 3 is another longitudinal view in section of the lamp socket shown in FIG. 1 taken from another side.

Referring to FIGS. 2 and 3 in addition to FIG. 1 the socket body 1 further has a first angle slot 13 and a second angle slot 14 near two opposite ends of wire groove 11. The negative pole contact metal plate 2 has (i) a toothed projection 21 which extends perpendicularly thereof from one lateral side thereof near the bottom thereof, (ii) a horizontal stop rod 23, (iii) a vertical tip 22 at the top, and (iv) a plurality of raised portions 24 vertically spaced along its back side. When the negative contact metal plate 2 is inserted into the second angle slot 14, the toothed projection 21 is disposed inside the socket body 1, the horizontal stop rod 23 engages the floor of the wire groove 11, the vertical tip 22 pierces the insulator of the electric wire 5 to make electric contact with the conductor therein, and raised portions 24 bear against the inside wall of the socket body 1. A locating plate 20 is provided which is mounted in the first angle slot 13. It has a horizontal stop rod 202 at its top which engages the floor O wire groove 11, a plurality of raised portions (not shown) vertically spaced along its back side which bear against the inside wall of the socket body 1, and a toothed projection 201 disposed inside the socket body 1.

When the base 41 of a bulb 4 is threaded into the socket body 1, the toothed projection 21 of the negative contact metal plate 2 and the toothed projection 201 of the locating plate 20 mesh with the threaded base 41 of the bulb 4 to hold the bulb 4 in position, and therefore the bulb 4 is prohibited from being pulled out of the socket body 1 axially.

What is claimed is:

1. A lamp socket of the type comprising a socket body to hold a lamp bulb, a socket cap fastened to said socket body to retain an electric wire in place in said socket body, a first contact metal plate and a second contact metal plate mounted in said socket body to connect the electric wire to the lamp bulb electrically, wherein: said second contact metal plate is mounted in one angle slot in said socket body, said second contact metal plate having a plurality of raised portions which bear against an inside wall of said socket body, a horizontal stop rod stopped against said socket body, and a toothed projection for meshing with a threaded ring contact of the lamp bulb; a locating plate is mounted in an angle slot in said socket body remote from said second contact metal plate, said locating plate having a plurality of raised portions bearing against the inside wall of said socket body, a horizontal stop rod stopped against said socket body, and a toothed projection for meshing with the threaded ring contact of said lamp bulb.

2. The lamp socket of claim 1 wherein the first contact metal plate has a projection disposed in an aperture in said socket body, said projection making contact with a contact of said lamp bulb, said second contact metal plate and said locating plate being disposed laterally on opposite sides of said first contact metal plate.

* * * * *